United States Patent [19]

Bernt

[11] 4,181,495

[45] Jan. 1, 1980

[54] INTERNAL SUSPENSION PREHEATER FOR LONG ROTARY KILNS

[76] Inventor: Jorgen O. Bernt, 1357 Amber Crescent, Oakville, Ontario, Canada

[21] Appl. No.: 876,535

[22] Filed: Feb. 9, 1978

[51] Int. Cl.[2] ..... F27B 7/14

[52] U.S. Cl. ..... 432/118; 34/135

[58] Field of Search ..... 432/110, 118; 34/135, 34/136, 137

[56] References Cited

U.S. PATENT DOCUMENTS

| | | | |
|---|---|---|---|
| 2,059,176 | 10/1936 | Newhouse | 432/118 |
| 3,811,270 | 5/1974 | Smith | 432/118 |

FOREIGN PATENT DOCUMENTS

| | | | |
|---|---|---|---|
| 550674 | of 1943 | United Kingdom | 34/135 |
| 567059 | of 1977 | U.S.S.R. | 432/118 |

*Primary Examiner*—John J. Camby

[57] ABSTRACT

A long rotary kiln which slopes and wherein the particulate material travels downwardly from the inlet toward the outlet end and counter flowing gas travels upwardly therethrough, is provided with a preheater between the inlet end and the main operational zone. The preheater provides lifting devices at its end farthest from the inlet to deposit the particulate material in the gas stream, and an impingement separator zone at its end nearest the inlet to cause the particulate material to lose its momentum and fall from the gas.

4 Claims, 7 Drawing Figures

INTERNAL SUSPENSION PREHEATER FOR LONG ROTARY KILNS

This invention relates to a suspension preheater for long rotary kilns of the type for making cement clinker, or of the type used for roasting, calcining, drying or like operations.

Such rotary kilns customarily comprise a long cylindrical kiln sloping downwardly wherein the material to be operated on travels downwardly, and heating gas travels in the opposite direction through the kiln. In the upper or entrance extent of the kiln the material to be operated on is introduced into the kiln.

It is an object of this invention to provide an extent of the kiln known herein as an 'internal suspension preheater', between the inlet end or upstream conventional preheating area and the main operational zone which is downstream and adjacent the outlet of the kiln. In the internal suspension preheater, the material is lifted and caused to fall through, and be carried by, the counter-flowing gas. An impingement separator to be described hereafter is provided on the inlet side of the lifting zone to remove from the counter flowing gas most of the solid material placed in the gas stream in the lifting zone.

Suspension preheaters have been previously known which caused particulate matter to be suspended in or to fall through a gas before the material thus treated was supplied to another apparatus. However such prior suspension preheaters have been separate from the other apparatus with which they were used and have not previously been combined in a long rotary kiln. Nor have they had the design described herein or been combined with the impingement separator described hereafter.

This invention provides a suspension preheater for a rotary kiln which forms part of the kiln itself and thus does not require separate equipment or means for coupling such suspension preheater to such long rotary kiln. The invention is incorporated in a long cylindrical kiln sloping downwardly wherein the material to be operated on travels downwardly and heating gas travels in the opposite direction through the kiln. The advantages and operation of the invention are described hereafter in relation to a long rotary kiln for making cement clinker and this is one of the principal applications of the invention. However it should be readily realized that the principal advantages and operating principles of the invention are applicable to other types of kilns. In the upper or entrance extent of the kiln for making cement clinker, the material to be converted to cement clinker, is introduced into the kiln in slurry or powder form, dried, and preheated. Downstream from this, the material is calcined or decarbonated and new chemical compounds are formed, resulting in the production of cement clinker. In a kiln for making cement clinker, the heating gases are combustion gases and the particulate material introduced at the inlet of the kiln is mainly particulate calcium carbonate $CaCO_3$.

It is an object of this invention to provide an extent of a kiln for making cement clinker, the extent being known herein as an 'internal suspension preheater', between the inlet end or upstream conventional preheating area and the extent where the clinker is formed which is downstream and adjacent the outlet of the kiln. In this intervening area the material is lifted and caused to fall through, and be carried by, the counter-flowing gas. An impingement separator to be described hereafter is provided on the inlet side of the lifter zone to remove from the counter flowing gas most of the solid material placed in the gas stream in the lifting zone.

This invention provides a suspension preheater for a rotary cement clinker kiln which forms part of the kiln itself and thus does not require separate equipment or means for coupling such separate equipment to a kiln.

In drawings which illustrate a preferred embodiment of the invention:

Figure 1:
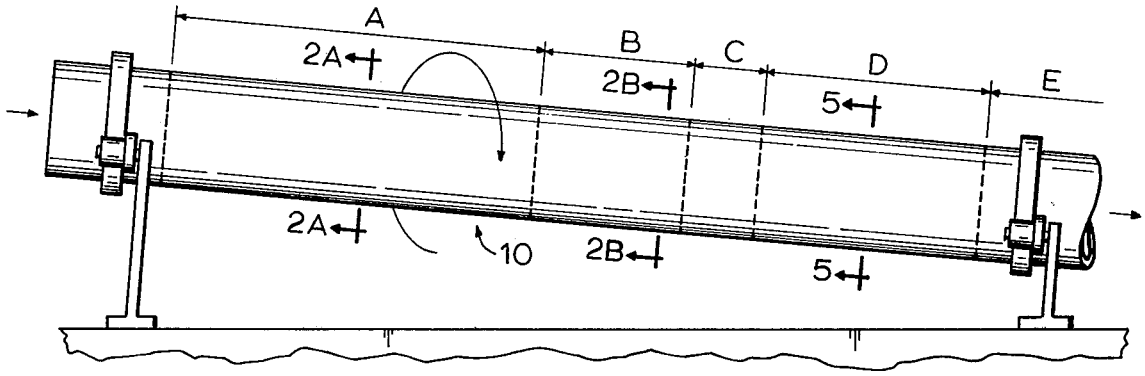
FIG. 1 shows a side view of the entrance portion of a kiln including conventional preheater Zone A, the inventive internal suspension preheater comprising Zones B, C and D and the upstream end of the main portion of the kiln, Zone E, in which Zone the formation of cement clinker takes place.
Figure 3:
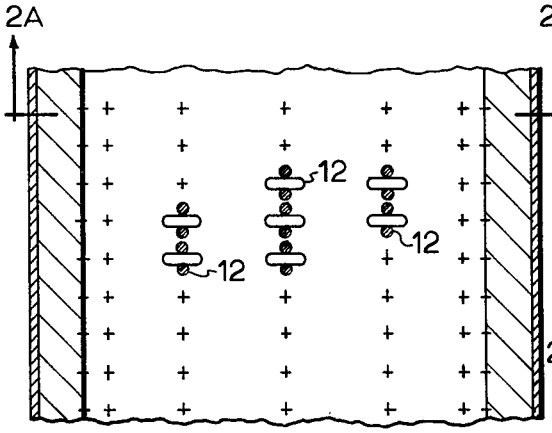
FIG. 3 shows the suspension points for chains in Zone A and is a cross sectional view along the line 3—3 of FIG. 2A.

In this application terms such as 'downstream' and 'upstream' refer to the direction of flow of particulate material in the kiln, from Zone A to Zone E and from left to right in FIG. 1. It is noted that this is opposite to the direction of heating gas flow.

In the drawings, the entrance end of a rotary cement kiln 10 is shown. The kiln 10 is divided into a conventional preheating Zone A and downstream therefrom follow: a dust impingement separator, Zone B; a heat exchange, Zone C; and a lifter Zone D and downstream therefrom (not completely shown) is the Zone E forming the main portion of the kiln where the formation of cement clinker is achieved.

Heating gases are introduced into the downstream end of the kiln to move through zones E-D-C-B-A and to cause: the formation of cement clinker in Zone E and the preheating and calcination (decarbonization) of the particulate material in Zones D-A. Since: the constituency of the particulate material introduced into Zone A, the constituency of the heating gases and the general operation of making cement clinker are well known to those skilled in the art; these matters are not discussed in detail herein.

Prior to this invention, decarbonization or calcination occurred in the Zone E, where cement clinker was formed, as well as in prior stages. As previously explained, the operation of the components of Zones B, C and D in accord with the invention, act to cause much of the calcination and decarbonization to occur upstream from Zone E, Zone E representing the kiln proper where the clinker is formed.

The conventional preheating Zone A is provided with conventional chain curtains. The conventional chain curtain uses a number of chains 12 suspended from the drum. Chains 12 in Zone A are relatively widely spaced, (as indicated in FIG. 2) and allow relatively large spaces therebetween for the passage of gas and dust carried thereby. The widely spaced chains 12 in the conventional preheater drag in the bed 14 of particulate material and are suspended thereabove during different parts of the kiln rotation. Particulate material for forming cement clinker is usually introduced into the kiln Zone A in the form of a wet slurry. With a wet slurry of particulate material entering the kiln and forming the bed in Zone A, the chains 12 become coated with wet material to which dust in the gas flowing upstream tends to adhere. This conventional chain curtain is extremely inefficient as a dust collector and a large proportion of the particulate material, entering Zone A in the upstream flowing gas, is lost, carried by the gas out of the entrance end (Zone A) of the apparatus and away from the kiln.

Figure 4:
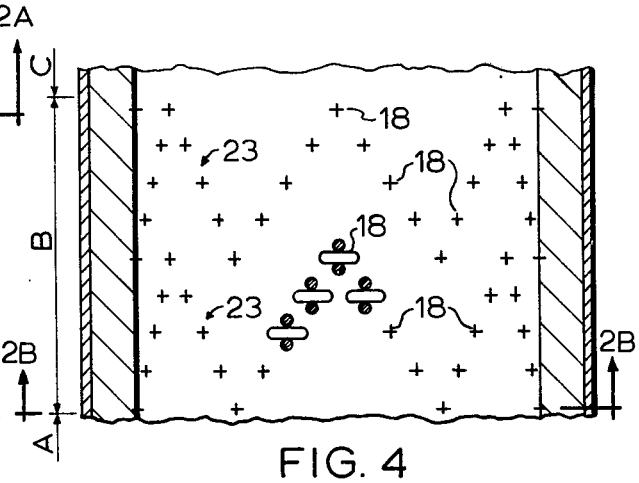
FIG. 4 shows the suspension points for chains in Zone B and is a view along the line 4—4 of FIG. 2B.

The inventive dust impingement separator in Zone B, uses chains 23 but the chains are employed to operate in accord with a different principle from the chains in Zone A. The chains in Zone B are so closely spaced (as viewed along the axis of the kiln) that almost all of the dust or particulate matter being carried upstream by the gas strikes at least one of the closely spaced chains. The result of such an impact is to deprive an upstream travelling impacting particle of substantially all its upstream momentum, causing such a particle to drop rapidly into the bed of particulate material instead of travelling out of the entrance end of the kiln. The chain suspension points 18 (FIG. 4) are preferably staggered as axially of the kiln to achieve closer spacing, as viewed axially of the kiln than can be achieved of the chains are suspended as closely as possible side by side. Chains 23 allow gas passage without undue flow resistance, while reducing the momentum of most particulate material in the gas.

Figure 2A:
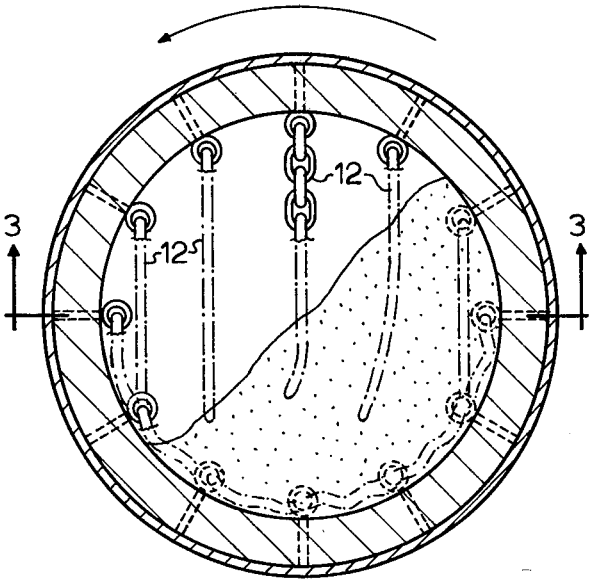
FIG. 2A shows a cross-sectional view of the conventional preheating Zone A along the line 2A—2A of FIG. 1 or FIG. 3.
Figure 2B:
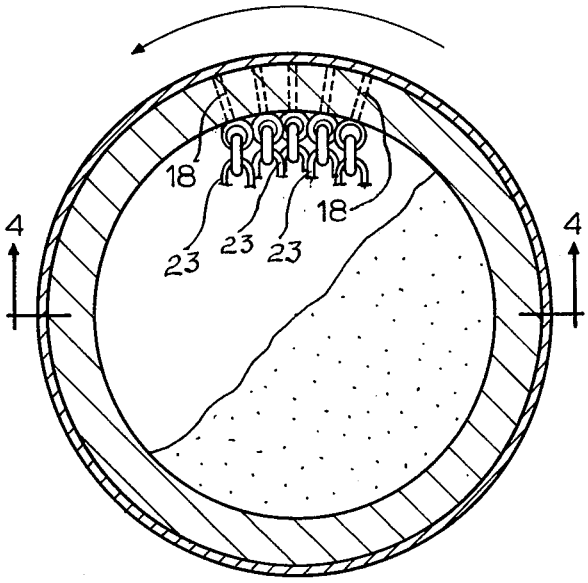
FIG. 2B shows a cross-sectional view of the inventive impingement separator in Zone B along the line 2B—2B of FIG. 1.

The chains 23 in Zone B, although more closely spaced, will be similar in structure to the chains 12 of FIG. 2. The axial view of the chains in Zone B, is shown in FIG. 2B and merely indicates an overlapping group of hanging chains. The arrangement of the chains 23 in Zone B may, perhaps, be better visualized from FIG. 4 and (by analogy) from FIG. 2A.

Thus the chains 23 in Zone B provide closely spaced impact areas on which dust in the gas stream will impinge when travelling upstream with the heating gas so that the dust will lose its upstream momentum and a high proportion will fall into the bed. Also, as previously discussed, the impact dust separator in accord with the invention provides one or more (here two) tiers of chains 23, with the tiers being axially disposed from each other. In each tier, chains 23 are hung from a series of points, which define a ring extending circumferentially about the inside of the kiln. Adjacent chains suspended at points 18 going circumferentially about the kiln, are staggered axially from each other, so that they may be suspended more closely together than if suspended side by side. The result, in the preferred embodiment, is the provision of two tiers of chains 23, each tier extending circumferentially around the kiln and having the suspension points 18 staggered axially forwardly or rearwardly so that going about the drum they are arranged in a zig-zag pattern. However other patterns which will allow the staggering, to allow the chains to be suspended more closely than side by side, would be within the scope of the invention; the general object of any such arrangement being to minimise the chances that particles, deposited into the gas stream in Zone D will travel through Zone B without impinging upon a chain 23. It is also within the scope of the invention to suspend the chains 23, closely side by side, (when viewed axially of the kiln;) although the staggered arrangements are preferred. The closely spaced chains of Zone B, provide advantages (as hereinafter described) that:

(a) They reduce the inefficiency and heat loss resulting from particles being carried out the inlet end of the kiln;

(b) They reduce the recombination of dust particles of CaO with $CO_2$ in the gas stream by removing the CaO particles from the gas stream; and (c) By removing most of the particles from the gas stream in Zone B, they allow the use of internal suspension preheating caused by the lifting of particles out of the bed and dropping them into the gas stream as performed in Zone D.

Just downstream from the inventive dust impingement separator in Zone B is suspension preheater Zone C usually but not necessarily having inspection hatches (closed in operation), temperature probes and the like, and a lifter Zone D, for lifting the particulate material and dropping it into the gas stream.

In lifter Zone D, a plurality of lifters 22 are located, a short distance downstream from the chains forming the dust impingement separator in Zone B, for lifting the particulate material from the bed at the bottom of the kiln. Each lifter 22 extends generally longitudinally along the Zone D portion of the kiln wall, usually in juxtaposed sections along all or part of the Zone D. The lifters 22 are designed to raise particulate material in the bed which the lifters encounter during their movement across the bottom of the kiln. The lifters 22 are shaped so that they release the particulate material which they carry, in approximately the upper quadrant of their rotation, i.e. between 10 and 2 O'Clock (either sense of rotation being acceptible, the lifters 22 being oriented to operate with the selected sense). (Counter clockwise rotation looking upstream is shown).

In Zone D, the advantages of the material lifters 22 in dispersing particles across the gas stream include the fact that the aggregate of the relatively large surface areas of the small gas-borne particles are exposed to the hot gas instead of the smaller area represented by the exposure of merely the outer surface of the bed of such material at the bottom of the kiln. Thus the heating of the particulate matter is much more effective than in conventional kilns and in the cement kiln with material temperatures of below 1200° F. and gas temperatures about 1900° F., it is found that a large amount of the calcination or decarbonization takes place in this lifter Zone D. Thus, with the inventive arrangement, much more of the calcination or decarbonization takes place in Zones D, C and B and less in the kiln proper (Zone E). In prior art arrangements such calcination or decarbonization takes place mainly in the kiln proper where the clinker formation takes place and this is less efficient and leads to a poorer product.

It is noted that the lifting may be performed efficiently in Zone D to deposit large amounts of the particulate material in the gas stream because of the presence of the impact dust separator in Zone B which removes a large proportion of the lifted particles from the gas stream.

A further advantage of the inventive arrangement, stemming from a combination of the lifter Zone D with Zones C and B is that components of the particulate material which have vaporized tend to recondense more often on the flying or suspended particles than on the equipment itself. This is in distinction to conventional or prior art preheaters where recondensation of vaporized materials takes place mainly on the hardware in the kiln, sometimes causing excessive buildup on such hardware.

The hanging chains in Zones A and B, (and in particular in Zone B) in causing removal of the particles from the gas travelling toward the inlet, reduce the heat capacity of the gas stream as it passes toward the kiln inlet from zone to zone. This minimizes the loss of high thermal capacity to areas where only low thermal capacity is required. Further the reduced travel of particulate matter upstream avoids the unnecessary recirculation upstream of material which is to be transported eventually out of the downstream end of Zone D. A further advantage from the use of the impingement dust separator in Zone B, is that some chemical reactions in the material which occur in Zones E, D, C, B due to the presence of the hot gas, are reversible, and it is desireable to remove the particles from the hot gas stream before they can travel upstream to a cooler zone where the reverse reaction may take place. In the cement kilns of the type with which the invention is used, the reaction $CaCO_3 \rightarrow CaO + CO_2$ is caused to take place in the Zones B, C and D. The reverse reaction $CaO + CO_2 \rightarrow CaCO_3$ will take place under conditions where the equilibrium pressure of $CO_2$ is lower than the partial $CO_2$ pressure in the ambient gases. To avoid the occurrence of such (undesired) reverse reactions to any substantial degree, the material having been calcined in the Zones B, C and D, is separated, as quickly as possible from the gases in which it is suspended, by the chains 23 in Zone B.

It will be appreciated that the action of the impingement separator Zone in preventing the recombination of CaO and $CO^2$ will be advantageous in other kilns (such as, for example, lime kilns) than those for making cement clinker. It should also be appreciated that there are other processes in other kilns to which the invention might apply, where it is desired to prevent recombination of a vaporizer component carried by the heating gases with a component in the particulate bed. It will be appreciated that the advantages of the impingement separator will be equally effective with such other processes and will equally combine with the advantages of a lifter zone.

A further advantage accrues from the fact that the majority of the calcination or decarbonization occurs in the suspension preheater Zones B, C and D and in particulate material which is in the gas stream rather than in the bed. In conventional kilns, during decarbonization or calcination, the carbon dioxide forms from calcium carbonate in a bed. If the carbonate bubbles out of the bed rapidly, a physical process known as fluidization tends to takes place, and the bed tends to act as a fluid and to flow out of the kiln before being clinkerized. The provision for calcination in the preheater where much of the carbon dioxide is removed from particles in suspension, greatly reduces the likelihood of fluidization occurring in the bed.

The kiln metal wall 30 lined with refractory 32 in Zone D is provided with lifters 22 shaped like shelves projecting approximately radially inwardly from the shell walls. The lifters 22 preferably of metal and in any event suitable for the temperatures and conditions encountered, may be attached to the shell 30 in any desired manner, which will sustain the weight of the lifter 22 and the particulate matter carried thereon.

Figure 6:
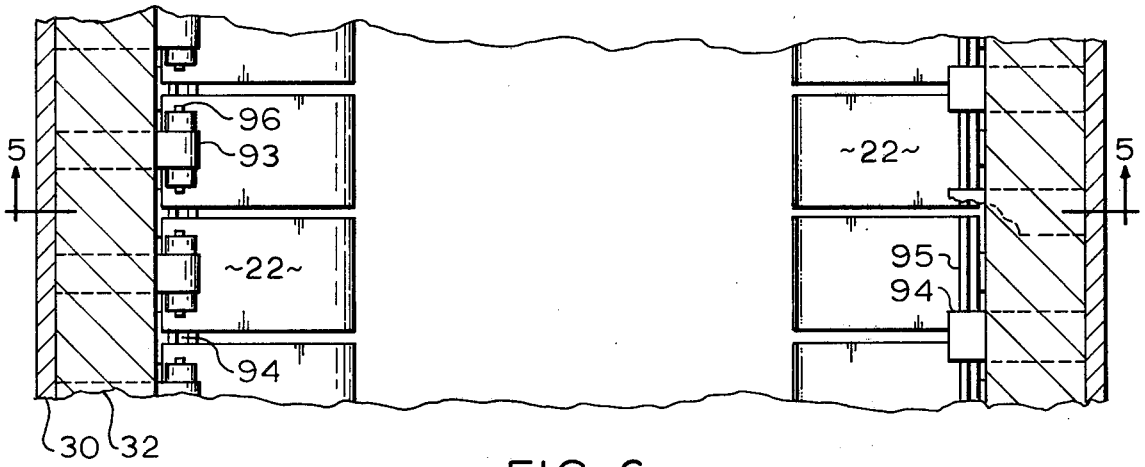
FIG. 6 is a partial section of Zone D taken along the lines 6—6 of FIG. 5.
Figure 5:
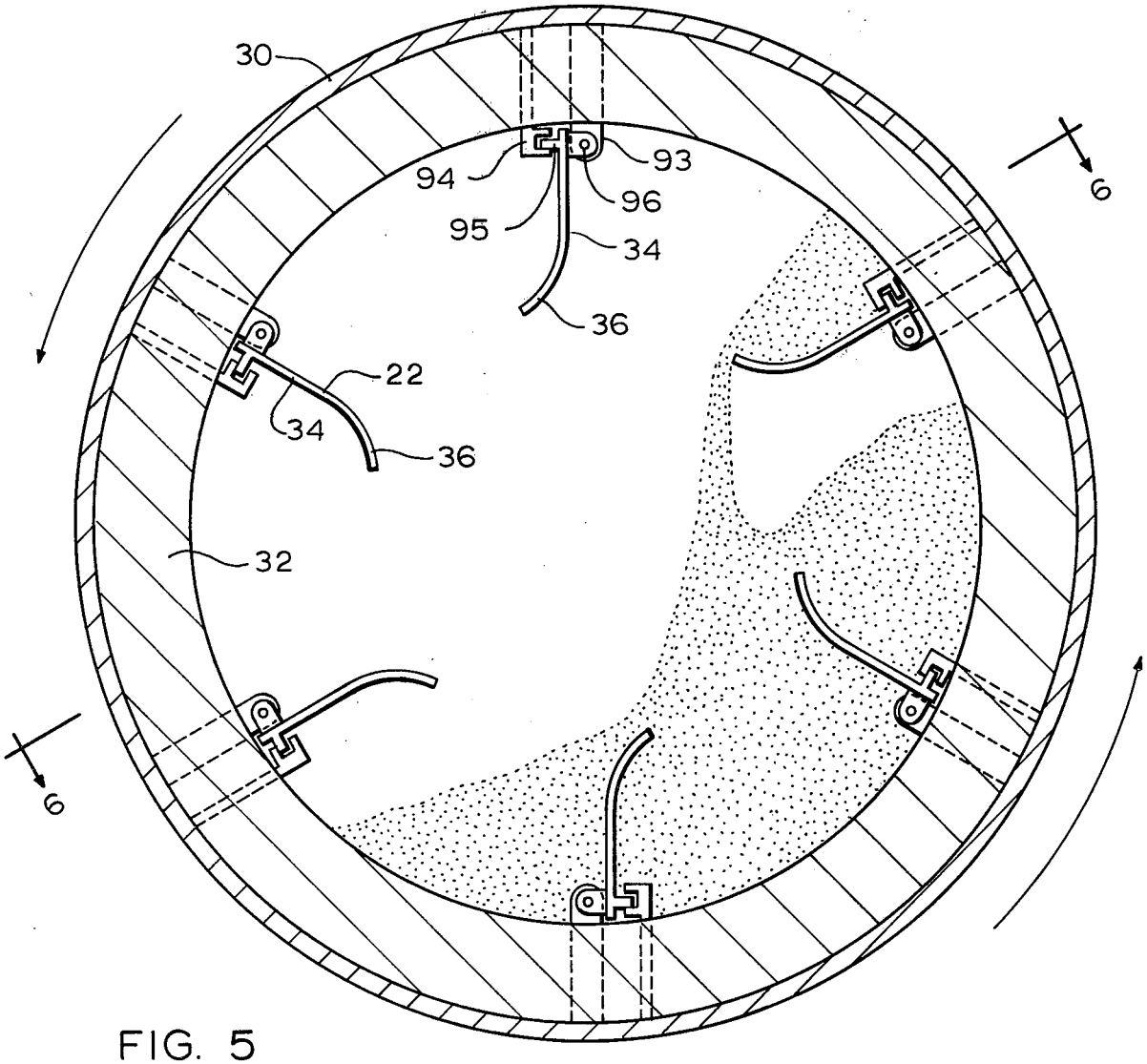
FIG. 5 is a cross-section of the lifter Zone D taken along the lines 5—5 of FIG. 1.

In the preferred arrangement of the lifters, the brackets 93 and holders 94 are rigidly mounted to extend inwardly from the kiln wall to project inwardly beyond the lining. Bracket 93 is provided with spaced, apertured ears to receive between them an apertured ear of the lifter so that the lifter may be mounted on the bracket, by the insertion of a removable pin 96. Before insertion of the pin 96 a ridge 95 on the lifter is inserted between two ridges on the holder 94 so that when the pin 96 is inserted through the aligned apertures of bracket and lifter, the lifter is retained in place. The lifter may be removed and replaced, when worn, by removal of the pin 96. As shown in FIG. 6 of the preferred arrangement is to have the brackets 93 and holders 94 straddling the gap between adjacent lifters to couple thereto as above described.

The lifters 22 are designed to start to release particulate material carried thereby at about 60° to 45° before top centre position of the lifter and to continue to release such material until all the material has been released therefrom at 45° to 60° past top centre position. In this way the material picked up by the lifter 22 is distributed into the gas stream across approximately the top quadrant of the device to fall through the gas stream or to be carried thereby. The lifters 22 are preferably shaped as shown in the drawing, having in cross-section, a flat extent 34 extending inwardly from the kiln wall, and an extent 36 curved upwardly (in the direction of rotation) at the free end. The flat extent 34 is oriented to be relatively horizontal when the lifter is about 90° from the top and the upward curve of extent 36 are designed to maintain material picked up in the lifter until the lifter is within about 60° to 45° of the top and to retain some material until the lifter is about 45° to 60° past the top. In the preferred embodiment, this is achieved by the upwardly curving outer end 36 of the lifter as shown.

The lifters 22 are, preferably, evenly spaced circumferentially about the kiln and in the preferred embodiment these are located at 60° intervals that is, there are 6 lifters equally spaced about the kiln. While any number of lifters may be used, the number will usually be between 4 and 12 and preferably equally spaced.

Although a number of short lifters may be used in the lifting, it is preferred that each lifter shall be a plurality of juxtaposed plates of the shape shown with the series of juxtaposed plates extending the length of the lifting Zone D.

It is found that with the inventive dust impingement separator arrangement (Zone B) only a small amount of calcium oxide is recarbonated, that is, recombined with carbon dioxide, to form calcium carbonate, which small amount only reduces the efficiency of the inventive kiln system insignificantly.

The preferred embodiment shows one preheater and dust curtain in accord with the invention. However the invention includes the alternatives where two or more suspension preheaters, each with lifters and a dust impingement separator Zone, in accord with the invention are arranged end to end between the conventional preheater and the conventional kiln proper. The invention also includes two or more impact separator stages followed by a single lifter stage downstream therefrom or a single impact separator stage with two or more lifter stages downstream therefrom. It is also noted that the impact separator is considered inventive and useful with a different lifter from that preferred and that the lifter Zone is considered inventive and useful with a different separating means.

I claim:

1. In a rotary kiln defining a cylindrical wall whose inner surface defines a downwardly sloping path for particulate material, from an inlet end towards a main operational zone, and having means for causing heating gases to flow upwardly therethrough;

shelf-like lifters attached to said kiln to project approximately radially inwardly from the said inner wall, designed to lift particulate material when said lifter is rising from the lower portion of said inner wall and discharge it into the heating gases when said lifter is rotated to the upper portion of said inner wall, said lifters being located at spaced locations about said inner wall and being located in a lifter zone between said main operational zone and said inlet end, an impingement separator zone located between said inlet end and said lifter zone;

a plurality of chains, in said impingement separator zone, suspended by one end at suspension points on said inner wall to hang from said inner wall said chain suspension points, in said zone, being arranged about the circumference of said inner wall, said suspension points being spaced so that the centre lines of those chains hanging from suspension points on the downwardly facing portion of said inner wall are each displaced from the next in a horizontal direction transverse to the kiln axis a distance less than twice the maximum width of the chain.

2. In a rotary kiln as claimed in claim 1 wherein said distance is less than the maximum width of a chain.

3. In a rotary kiln having a cylindrical wall whose inner surface defines a downwardly sloping path for particulate material from an inlet toward a main operational zone, wherein heating gases are caused to flow therethrough in the opposite direction to that of travel of said material, a lifting zone in said kiln between said inlet end and said main operational zone for causing transfer of particulate material from said bed into such heating gases, an impingement separator zone located between said inlet end and said lifter zone, a plurality of chains, in said impingement separator zone suspended by one end at suspension points to hang from said inner wall, said chain suspension points being arranged about the circumference of said inner wall, said suspension points being spaced so that the centre lines of these chains hanging from suspension points on the downwardly facing portion of said inner wall are each displaced from the next in a horizontal direction transverse to the kiln axis a distance less than twice the maximum width of the chain.

4. In a rotary kiln as claimed in claim 3 wherein said distance is less than the maximum width of a chain.

* * * * *